US011541676B2

(12) United States Patent
Ahmed

(10) Patent No.: US 11,541,676 B2
(45) Date of Patent: Jan. 3, 2023

(54) POSITIONING AID FOR A STAMPING TOOL

(71) Applicant: Tasnim Ahmed, Jamesville, NY (US)

(72) Inventor: Tasnim Ahmed, Jamesville, NY (US)

( * ) Notice: Subject to any disclaimer, the term of this patent is extended or adjusted under 35 U.S.C. 154(b) by 0 days.

(21) Appl. No.: 17/741,160

(22) Filed: May 10, 2022

(65) Prior Publication Data

US 2022/0355601 A1 Nov. 10, 2022

Related U.S. Application Data

(62) Division of application No. 17/316,425, filed on May 10, 2021, now Pat. No. 11,312,165.

(51) Int. Cl.
*B41K 3/62* (2006.01)
*B41K 3/02* (2006.01)

(52) U.S. Cl.
CPC . *B41K 3/62* (2013.01); *B41K 3/02* (2013.01)

(58) Field of Classification Search
CPC ... B41K 3/00; B41K 3/02; B41K 3/24; B41K 3/44; B41K 3/46; B41K 3/54; B41K 3/62
See application file for complete search history.

(56) References Cited

U.S. PATENT DOCUMENTS 8,393,266 B2 * 3/2013 Rasmussen ..... B41F 1/04 101/287
10,513,135 B1 * 12/2019 Gessner ..... B41K 3/00
10,960,696 B1 * 3/2021 Garza ..... B41K 3/02
11,014,389 B1 * 5/2021 Cottrell ..... B41K 3/46
11,059,312 B2 * 7/2021 Ericson ..... B41K 3/02
2007/0193049 A1 * 8/2007 Vetromila ..... G01B 3/04 33/436
2013/0206026 A1 * 8/2013 Konik ..... B41K 3/62 101/368
2019/0135006 A1 * 5/2019 Ericson ..... E05D 7/1072
2020/0114672 A1 * 4/2020 Garza ..... B44B 5/0052

FOREIGN PATENT DOCUMENTS

GB 2503660 * 1/2014
GB 2558988 * 7/2018

* cited by examiner

*Primary Examiner* — Matthew G Marini
*Assistant Examiner* — Marissa Ferguson-Samreth
(74) *Attorney, Agent, or Firm* — Barry Choobin; Patent 360

(57) ABSTRACT

An assembly for precise positioning of a stamping tool, such as a photopolymer stamp. The assembly having a flat base of preferably a square shape. A platform of a predetermined height runs along the periphery of the flat base. A grid film removably adhered to the top surface of the flat base. Four alignment tabs can be provided on the four corners of the platform. A flip plate dimensioned to fit over the platform, such as corners of the flip plate juxtapose to the alignment tabs. A portion of the flip plate extends sidewards from the periphery of the platform, such as the flip plate can be lifted. The clear flip plate having radial lines that extend from the center to the periphery of the flip plate.

8 Claims, 4 Drawing Sheets

POSITIONING AID FOR A STAMPING TOOL

CROSS-REFERENCE TO RELATED APPLICATIONS

This application is a continuation of a U.S. patent application Ser. No. 17/316,425 filed on May 10, 2021, which claims priority from a U.S. Provisional Patent Application No. 63/150,252, filed on Feb. 17, 2021, both of the above applications are incorporated herein by reference in its entirety.

FIELD OF INVENTION

The present invention relates to an assembly for positioning a stamping tool, and more particularly, the present invention relates to an assembly for precisely positioning a photopolymer stamp on an artistic media.

BACKGROUND

Stamping is a common method for transferring a pattern to artistic media, such as greeting cards, cardstock, and paper. The pattern can be engraved on a rubbery stamping tool which can then be used to print the pattern on multiple artistic media. Ink can be first transferred to the stamping tool which can then be applied to the destined object.

Acrylic and photopolymer stamps are generally available in a range of designs for art and craft. For example, premade stamps are available for printing an artistic design on a greeting card. Photopolymer stamps are advantageous over acrylic stamps being able to produce more sharp and crispy patterns.

However, precisely aligning a stamp on an artistic media can be problematic. Additionally, it is common that the first attempt of stamping may not result in a clean impression, and repeated stamping may be needed. Realigning the stamping tool in the exact position as the previous position can be difficult.

Thus, a desire is there for an assembly that may allow precisely positioning a stamping tool on artistic media.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an assembly for precisely positioning a stamping tool.

It is another object of the present invention that the assembly is easy to use.

It is still another object of the present invention that the assembly is economical to manufacture.

In one aspect, disclosed is an assembly for precise positioning of a stamping tool, such as a photopolymer or rubber stamp. The assembly having a flat base of preferably a square shape. A platform of a predetermined height runs along the periphery of the flat base. A grid film removably adhered to the top surface of the flat base. Four alignment tabs can be provided on the four corners of the platform. A flip plate dimensioned to fit over the platform, such as corners of the flip plate juxtapose to the alignment tabs. A portion of the flip plate extends sidewards from the periphery of the platform, such as the flip plate can be lifted. The clear flip plate having radial lines that extend from the center to the periphery of the flip plate.

In one aspect, the grid film and the radial lines allow aligning the photopolymer stamp on the artistic media.

In one aspect, the height of the platform relative to the flat base is such as to accommodate the grid film, artistic media, and the photopolymer stamp.

In one aspect, the thickness of the four alignment tabs can be more than the thickness of the flip plate.

In one aspect, the flip plate over the platform can be retained over the platform between the four alignment tabs, wherein the alignment tabs prevent even slight lateral movements of the flip plate over the platform.

In one aspect, the flip plate can be transparent or translucent.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
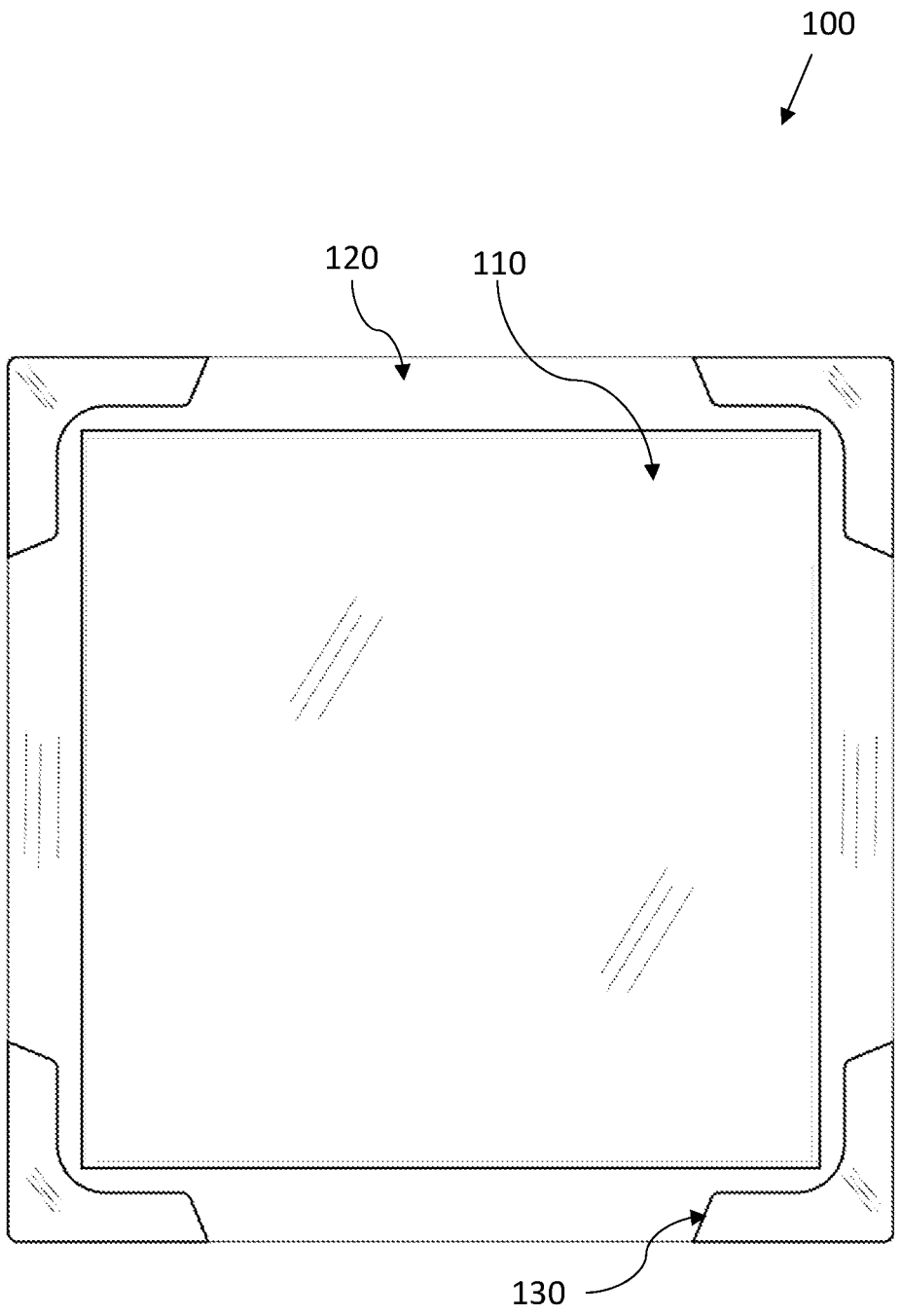
FIG. 1 shows the frame of the disclosed assembly having a flat base, a platform around the periphery of the flat base, and four alignment tabs at four corners of the platform, according to an exemplary embodiment of the present invention.

Referring to FIG. 1 which shows frame 100 of the disclosed assembly. The frame 100 can have a flat base 110 of preferably a square shape. The dimensions of the square base 110 can be such as to receive an artistic media i.e., the area of the flat base can be more than the dimensions of the artistic media. The artistic media can be card stock, invitation cards, contact cards, and like. Around the flat base 110 can be seen a platform 120 that runs along the periphery of the flat base 110. The platform 120 can also have a square periphery and a flat top surface. The height of the platform 120 above the flat base 110 can be such as to accommodate a grid film, artistic media, and the photopolymer stamp on the flat base. The height of the platform relative to the flat base can be proportional to the combined height of the grid film, the artistic media, and the photopolymer stamp. Photopolymer stamps of standard thickness are generally available. The height of the platform relative to the base can be varied based on the standard sizes of the photopolymer stamps.

At four corners of the platform 120 can be seen four alignment tabs 130. The alignment tabs 130 can have a wall of predefined height and a top surface. The inner side of the alignment tabs can be round with diagonal cuts at the ends. The width of the alignment tabs can be less than the width of the platform.

Figure 2:
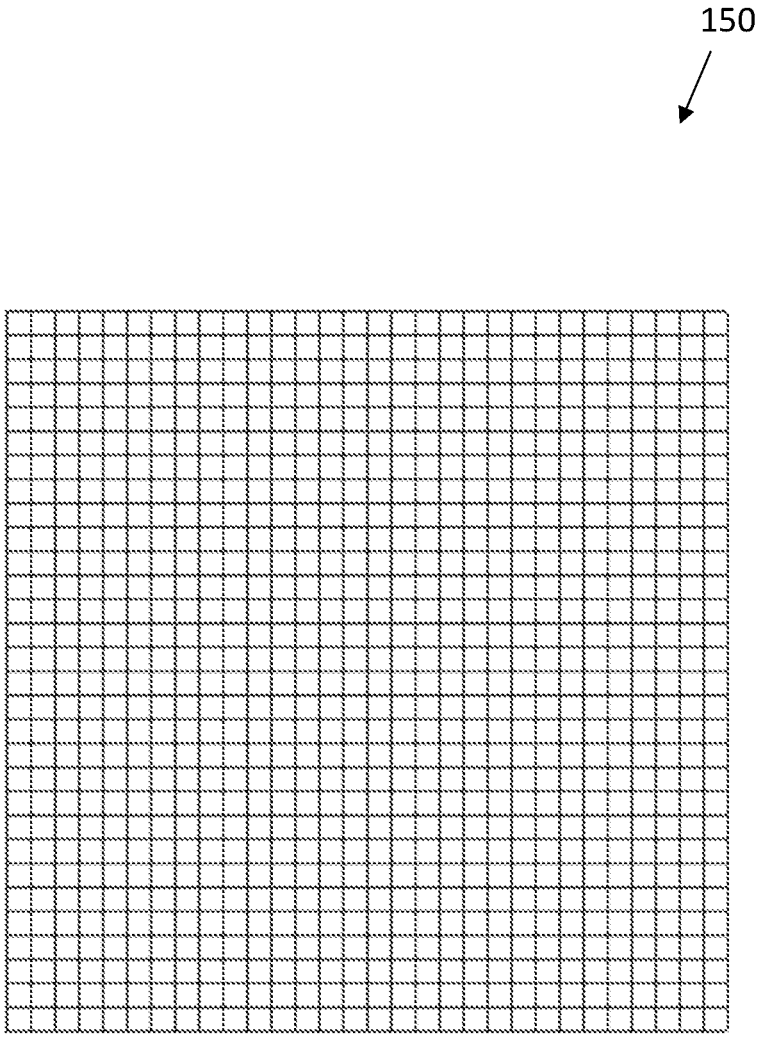
FIG. 2 shows the grid film of the assembly, according to an exemplary embodiment of the present invention.

Referring to FIG. 2 which shows the grid film 150. The grid film has regularly spaced grid lines that may help to align the artistic media on the grid film. The grid film 150 can be dimensioned to be placed onto the flat base 110. The grid film 150 can be made of sticky or rubbery material, such as silicone that may allow removably adhering the grid film 150 to the flat base 110. The adhesive nature of the grid film may ensure that the grid film does not slip on the flat base and ensures the artistic media will stay in place. The artistic media on which pattern can be printed is placed on the grid film. The artistic media can be aligned relative to the grids of the grid film, moreover, the grid film may also have a scale to aid in the alignment of the artistic media.

Figure 3:
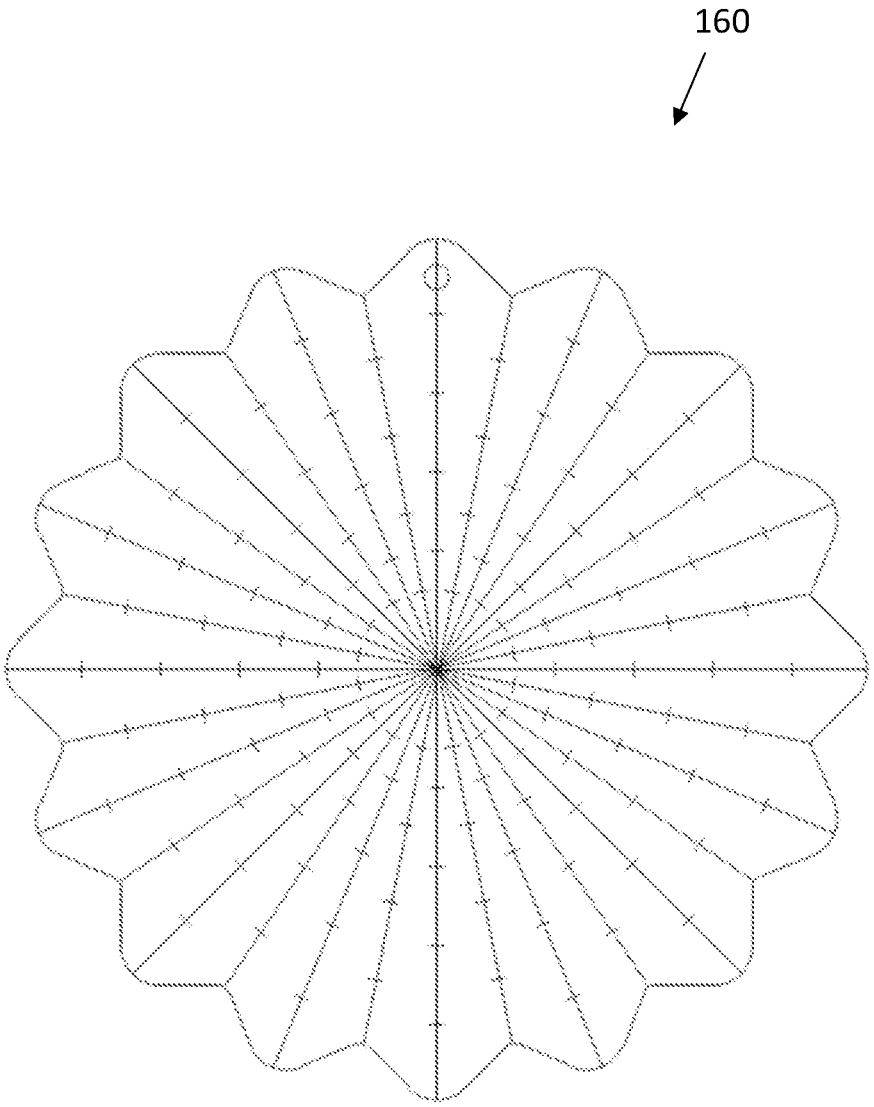
FIG. 3 shows the flip plate of the assembly, according to an exemplary embodiment of the present invention.

FIG. 3 shows the flip plate 160 of the assembly that can fit over the platform. Four corners of the flip plate can be juxtaposed with the four alignment tabs on the corners of the platform, such as the flip plate can fit over the platform. The round shape of the corners of the flip plate 160 can be dimensioned to align to the round inner wall of the alignment tabs 130. The flip plate can snugly and smoothly slide through the alignment tabs and be placed on the platform, such as to prevent any lateral movement of the flip plate. Moreover, the sides of the flip plate can extend sidewards of the platform, which may allow the flip plate to be lifted by grabbing through hands. The flip plate may be transparent to translucent and have radial lines that extend from the center to the periphery of the flip plate. In one case, the radial lines can be etched on the clear flip plate. The radial lines may aid in the precise alignment of the photopolymer stamp relative to the artistic media.

Figure 4:
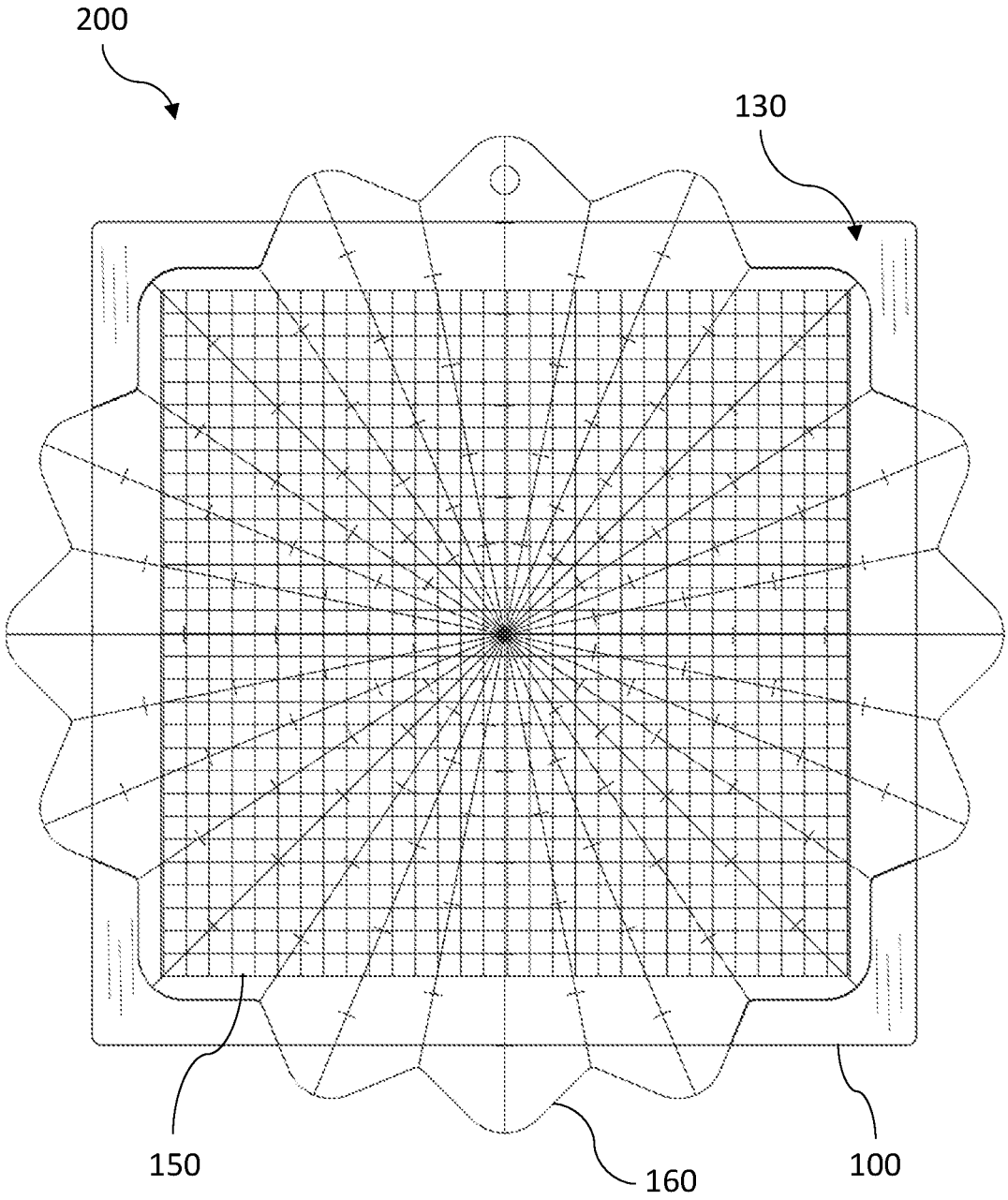
FIG. 4 shows the disclosed assembly, according to an exemplary embodiment of the present invention.

FIG. 4 shows the assembly 200 having the flat base on which the grid film 150 is placed. Moreover, the flip plate 160 can also be seen placed on the platform. For stamping, the grid film can adhere to the flat base. Thereafter, the card stock or similar artistic media can be placed over the grid film. The card stock can be positioned relative to the grid film, for example, edges of the card stock can be aligned to the grid. Thereafter, the stamp can be placed on the desired position on the artistic media. Once, the stamp is in place, the clear flip plate 160 can be fit onto the platform, wherein corners of the flip plate 160 can be aligned to the alignment tabs 130 of the platform. The polymeric stamp adheres to the inner surface of the flip plate 160. Suitable pressure may be applied to the flip plate for adhering to the stamp. Once, the stamp adheres to the flip plate, the flip plate can be removed and inverted. The ink can then be applied to the stamp. For example, the round ink pad can be used to transfer ink to the stamp. Thereafter, the clear flip plate can be again inverted and placed onto the platform. Moreover, slight pressure may also be applied to the flip plate to uniformly transfer the ink pattern to the artistic media. In case, the ink is not uniform in the pattern, the process can be repeated i.e., the flip tab can be removed, and ink applied again to the stamp. The flip plate can then be put on the platform to transfer the ink to the artistic media.

The grid film can be made of any soft material, such as silicone or photopolymer that adheres to a surface and resist slip. Such material are known to provide grip. Also, known as slip resistant photopolymer or silicone. The grid film can adhere to the top surface of the base and the artistic media, such as the artistic media does not slip.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method of stamping an artistic media using a photopolymer stamp, the method comprises the steps of:

providing an assembly for positioning a stamping tool, the assembly comprising:

a frame comprising:

a base having a flat top surface and dimensioned to receive an artistic media, an elevated platform along periphery of the base, the elevated platform is of a predefined height relative to the flat top surface of the base, the predefined height is proportional to a thickness of a stamping tool, the flat top surface and the elevated platform define an inner volume of the base, a plurality of alignment tabs at corners of the elevated platform, each of the plurality of alignment tabs has an inner side, a flip plate dimensioned to fit over the elevated platform and between the plurality of alignment tabs, wherein the plurality of alignment tabs restricts lateral movement of the flip plate, and a grid film configured to removably couple to the flat top surface of the base, the grid film has a grid, grid film dimensioned to be received within the inner volume of the base;

placing the artistic media on the grid film, the grid film on the flat top surface of the base;

upon placing the artistic media, positioning the photopolymer stamp on the artistic media;

upon positioning the photopolymer stamp, placing the flip plate on the elevated platform and between the plurality of alignment tabs, such as the photopolymer stamp adheres to a bottom surface of the flip plate;

removing the flip plate from the elevated platform and thereafter inverting the flip plate;

applying ink to an exposed surface of the photopolymer stamp adhered to the flip plate; and upon applying the ink, inverting, and repositioning the flip plate over the elevated platform, such as the photopolymer stamp contacts the artistic media.

2. The method according to claim 1, wherein the flip plate has a plurality of radial lines that extends from a center of the flip plate up to its periphery, wherein the plurality of radial lines configured to aid in precise alignment of the stamping tool relative to the artistic media.

3. The method according to claim 2, wherein the flip plate is transparent or translucent.

4. The method according to claim 1, wherein the base is square having four corners, the elevated platform has four corners, and four alignment tabs are at the four corners of the elevated platform.

5. The method according to claim 1, wherein a plurality of side portions of the flip plate juxtaposes to the respective inner sides of the plurality of alignment tabs.

6. The method according to claim 5, wherein each inner side of the plurality of alignment tabs is concave in shape, each of the plurality of side portions of the flip plate is rounded that corresponds to the concave inner side of the each of the plurality of alignment tabs.

7. The method according to claim 6, wherein the flip plate is substantially round.

8. The method according to claim 1, wherein the grid film is made of photopolymer or silicone configured to adhere to the flat top surface of the base and the artistic media.

* * * * *